United States Patent [19]

Douty et al.

[11] Patent Number: 4,826,442

[45] Date of Patent: May 2, 1989

[54] SOLDERABLE CONNECTOR RETENTION FEATURE

[75] Inventors: George H. Douty, Mifflintown; Clair W. Snyder, Jr., York; James S. Staron, Millersburg, all of Pa.

[73] Assignee: AMP Incorporated, Harrisburg, Pa.

[21] Appl. No.: 188,098

[22] Filed: Apr. 27, 1988

Related U.S. Application Data

[63] Continuation of Ser. No. 943,972, Dec. 19, 1986, abandoned.

[51] Int. Cl.[4] ..... H01R 4/66

[52] U.S. Cl. ..... 439/92; 439/83; 439/566

[58] Field of Search ..... 439/83, 544, 554, 557, 439/566, 569, 570, 593

[56] References Cited

U.S. PATENT DOCUMENTS 3,902,777 9/1975 Anhalt et al. ..... 339/17 C
4,231,628 11/1980 Hughes et al. ..... 339/17 LC
4,609,242 9/1986 Kemppainen ..... 439/554 X
4,611,878 9/1986 Hall et al. ..... 439/610
4,628,410 12/1986 Goodman et al. ..... 361/413

*Primary Examiner*—Eugene F. Desmond
*Attorney, Agent, or Firm*—David L. Smith

[57] ABSTRACT

A solder clip (52) is formed independent of the molding of a connector housing (26) and inserted into recessed channels (50) in the mounting face (36) of the housing (26). The solder clip (52) is inserted until a stop (62) is reached thereby positioning the solder clip (52) relative to the housing (26). The leading corners (56) of the solder clip (52) are rounded to facilitate insertion of the solder clip (52) in the recessed channels (50). A portion of the base (54) of the solder clip (52) is offset (64) from the plane of the remainder of the base (54) to provide an interference fit with the channels (50) to maintain the position of the solder clip (52) in the channels (50). The solder clip (52) may have a solder tail (58) or a raised rib (66) for soldering to a printed circuit board (48). The solder clip (52) provides mechanical retention of the housing (26) on a printed circuit board (48) and may also serve as a ground.

16 Claims, 4 Drawing Sheets

SOLDERABLE CONNECTOR RETENTION FEATURE

This application is a continuation of application Ser. No. 943,972 filed Dec. 19, 1986, now abandoned.

BACKGROUND OF THE INVENTION

This invention relates to an electrical connector and in particular to an electrical connector having a solderable mechanical retention feature that can be attached to the connector housing subsequent to molding thereof.

Known retention means to secure a connector to a printed circuit board include rivets, bolts and nuts, plastic snap lock posts and heat stakes. U.S. Pat. No. 4,231,628 discloses an electrical connector for mounting on a printed circuit board. Support or mounting posts are formed on the same carrier strip as the conductor blanks. The mounting posts and conductor blanks are formed, severed from the carrier strip and integrally molded into the housing.

It would be desirable to have a solderable connector retention means that could be secured in the housing subsequent to molding and that would secure a connector to a printed circuit board in the same soldering process as secures the connector solder tails and other components to the board thus avoiding working on both sides of the printed circuit board as many of the known connector securing techniques require. Attaching the solderable retention means to the housing subsequent to molding would simplify the molding process.

SUMMARY OF THE INVENTION

In accordance with the present invention, a connector having a dielectric housing having contact passages extending therethrough with contacts secured therein has a pair of parallel channels recessed from the mounting face. A solder clip extends between the channels. The solder chip may have a solder tail extending normal to the mounting face. The solder clip has rounded leading corners to facilitate insertion of the solder clip into the channels. The solder clip is inserted in the channels until a stop is reached which determines the position of the solder clip relative to the housing. The trailing edge of the solder clip in the region of the channels is offset from the plane of the solder clip to provide an interference fit between the solder clip and the channels that maintains the position of the solder clip in the channels.

In this manner, the solder clip may be formed independent of the connector contacts. Furthermore, the connector housing may be molded and the solderable retention feature subsequently added to the housing, thereby simplifying the molding as compared to integrally molded retention means.

DESCRIPTION OF THE PREFERRED EMBODIMENT

Figure 1:
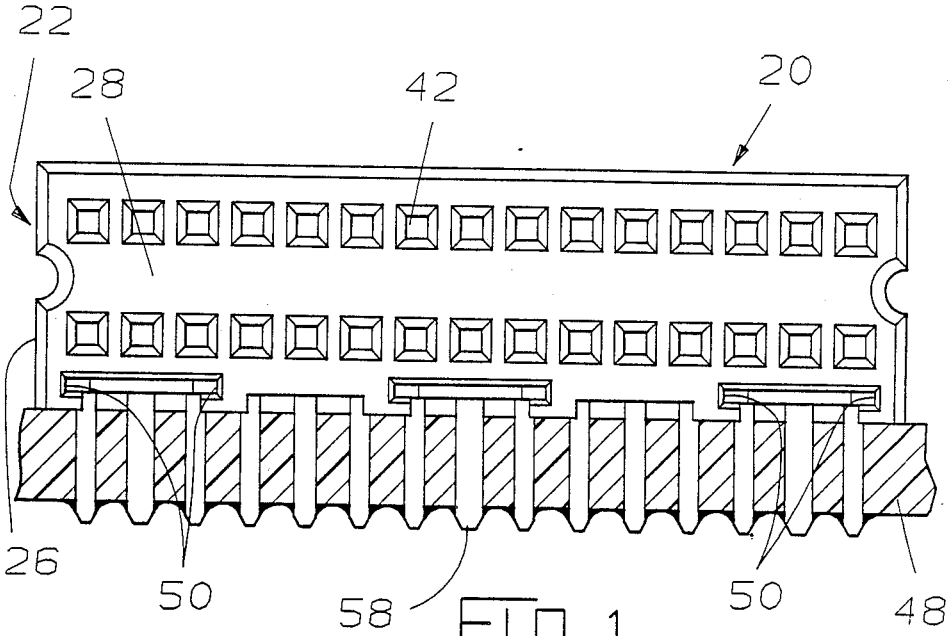
FIG. 1 is a front view of a receptacle in accordance with the present invention, mounted on a printed circuit board.
Figure 2:
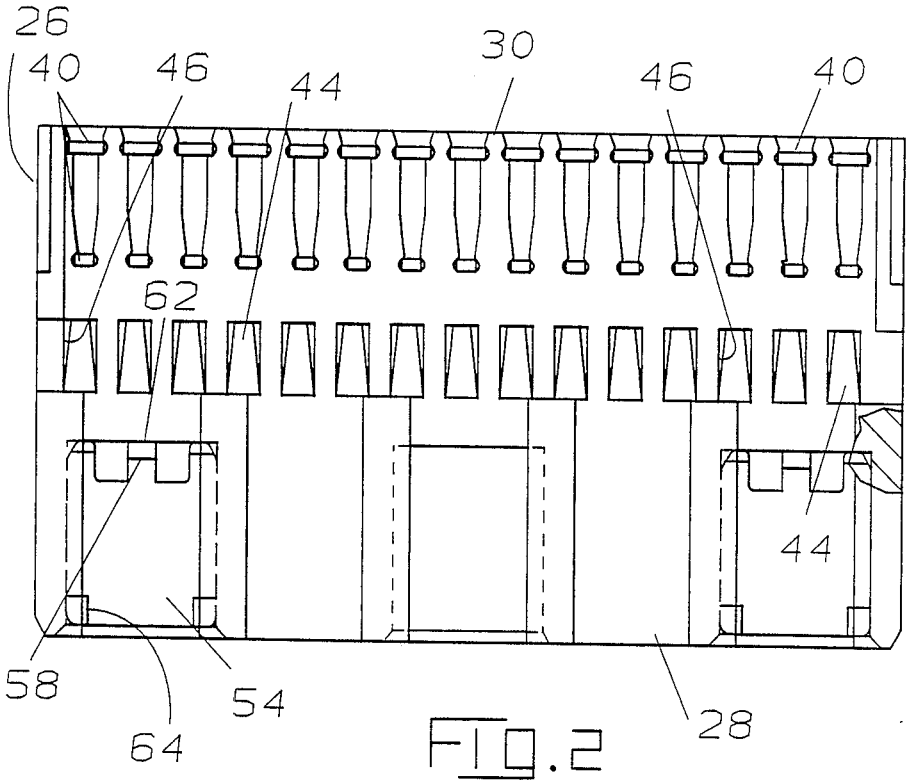
FIG. 2 is a bottom view of the receptacle shown in FIG. 1.
Figure 3:
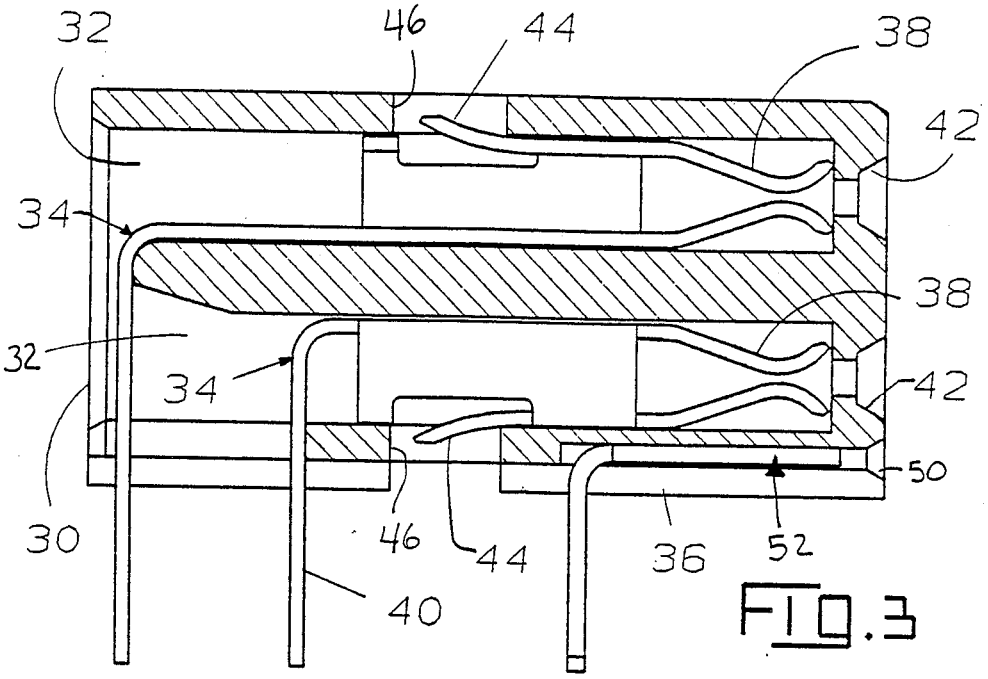
FIG. 3 is a sectional side view of the receptacle shown in FIG. 1.
Figure 7:
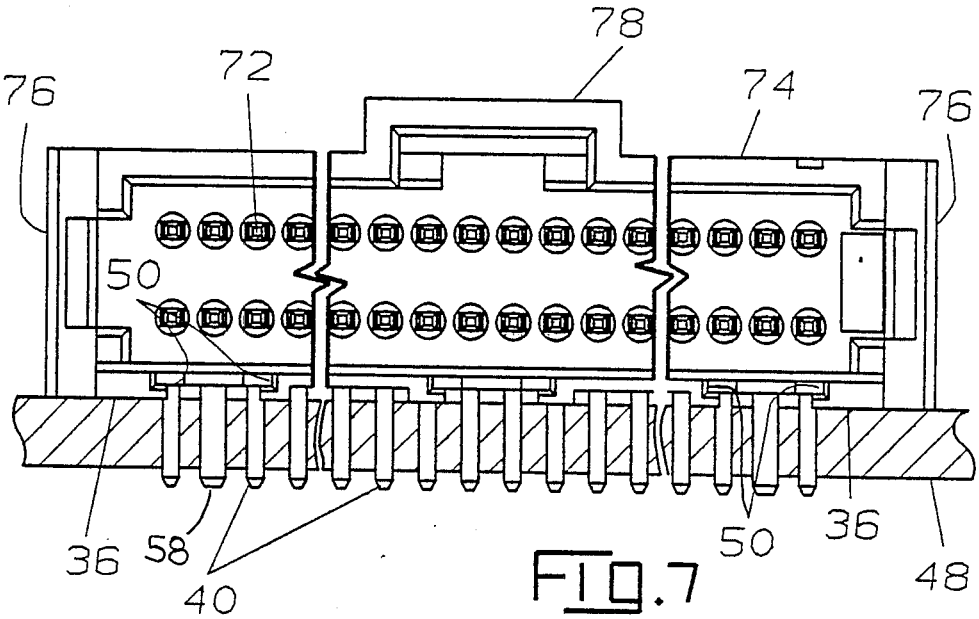
FIG. 7 is a front view of a shrouded header in accordance with the present invention, mounted on a printed circuit board.
Figure 8:
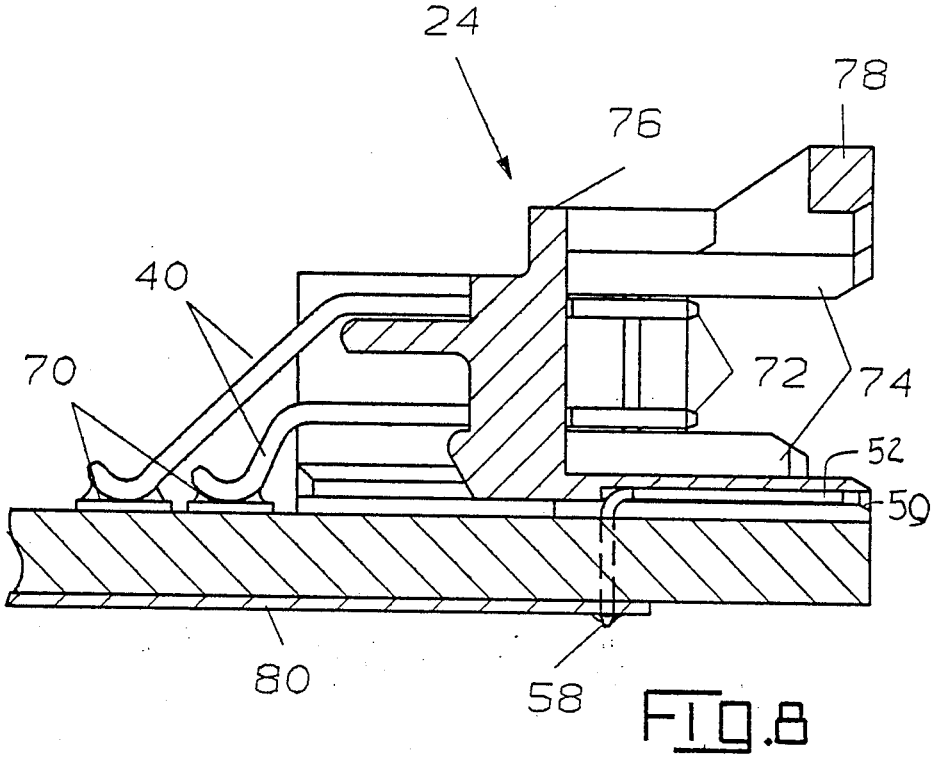
FIG. 8 is a side view of a shrouded header for surface mount applications.

Referring to the drawing, initially to FIG. 1, there is depicted therein a front view of a connector 20 in accordance with the present invention. Connector 20 may take various forms including receptacle 22 as shown in FIGS. 1–3 or shrouded header 24 as shown in FIGS. 7 and 8. Connector 20 has insulative housing 26 molded of thermal plastic, a mating face 28, an opposed rear face 30 and a plurality of contact receiving passages 32 extending therebetween having contacts 34 secured therein.

Bottom face 36 of connector 20 is at a right angle with respect to mating face 28. Contacts 34 extend from mating face 28 rearward thence bend substantially perpendicular to pass through bottom face 36 as best seen in FIG. 3. Contacts 34 in receptacle 22 are terminals having sockets 38 on one end and solder tails 40 on the other end. Contacts 34 are slidingly received in contact receiving passages 32 from rear face 30. When fully inserted, contacts 34 engage the housing behind guided entry 42 adjacent mating face 28. A locking lance 44 on each contact 34 extends into a respective aperture 46 to secure contacts 34 in passages 32. In a preferred embodiment of a two row connector, the vertical spacing between ows of contacts 34 is twice the distance of the lateral spacing with the spacing being maintained at both the mating face and the footprint of the solder tails 40.

During mating sockets 38 receive pins of a complementary connector. The mating force tends to rotate connector 20 lifting the bottom face from circuit board 48. The tendency for connector 20 to rotate is greater when stubbing occurs, although stubbing is virtually eliminated by guided entry 42 which, due to the champhered shape, assists posts of a complementary connector to mate with sockets 38.

To overcome the tendency to rotate, bottom face 36 has recessed channels 50 to accommodate mechanical retention means for securing connector 20 to printed circuit board 48. In a preferred embodiment, channels 50 are perpendicular to mating face 28. The entry of channels 50 are champhered to facilitate insertion of solder clip 52. The base 54 of solder clip 52 extends substantially between channels 50. The thickness of the base 54 of solder clip 52 is substantially the internal height of channel 50.

Figure 4:
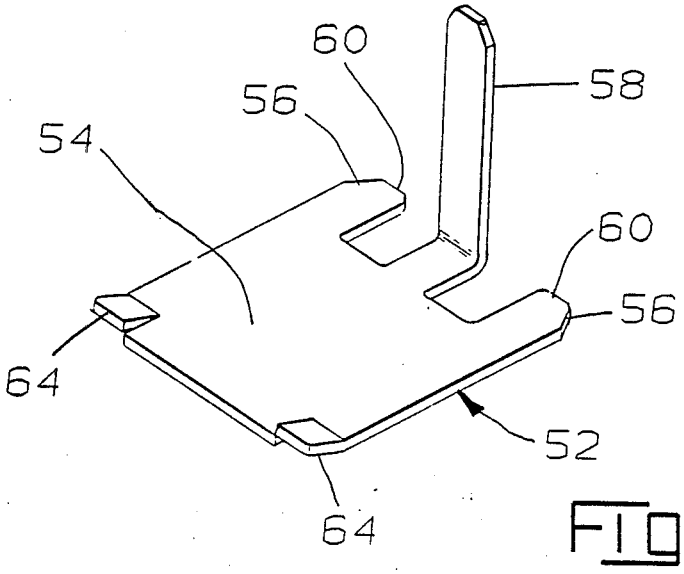
FIG. 4 is a bottom perspective view of a solder clip.

As seen in FIGS. 2 and 4, the leading corners 56, relative to inserting solder clip 52 into channels 50, are rounded or tapered to facilitate sliding solder clip 52 along channels 50 during insertion. In a preferred embodiment, solder clip 52 has an integral solder tail 58 extending normal to base 54 for insertion into a plated through hole in printed circuit board 48.

Solder clip 52 is slid into channels 50 until a stop is reached which determines the position of the solder clip and hence solder tail 58. In a preferred embodiment, leading edge 60 engages stop 62 molded in housing 26 to position solder clip 52 and hence solder tail 58 relative to housing 26.

The edge of base 54 in the region that passes through channels 50 is offset 64 from the plane of base 54 to provide an interference fit between solder clip 52 and channels 50, thus maintaining the position of solder clip 52 and thus solder tail 58. Attempting to slide solder clip 52 away from stop 62 would cause offsets 64 to bite into channel 50.

Figure 6:
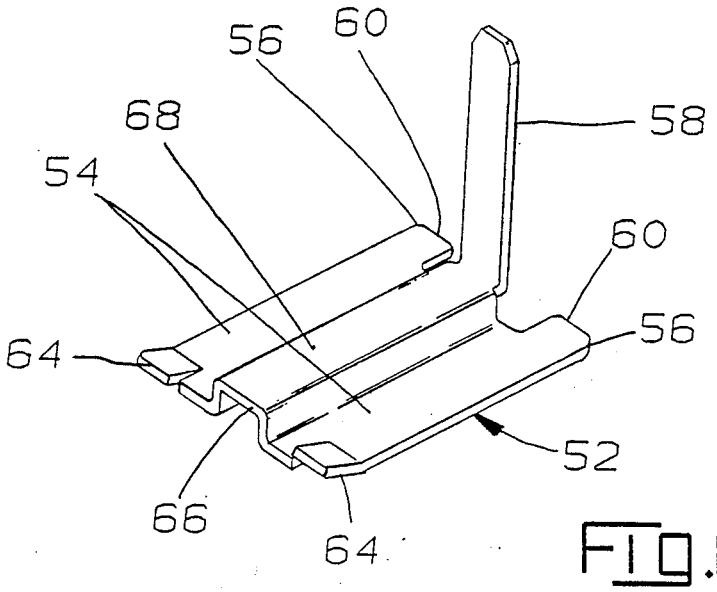
FIG. 6 is an alternate embodiment of the solder clip of FIG. 4.

An alternate embodiment of a solder clip 52 is shown in FIG. 6 having a longitudinal rib 66 that parallels channels 50. Surface 68 of rib 66 provides a surface area that is slightly recessed from the plane of bottom face 36 to accommodate soldering to a solder pad 70 on a printed circuit board in a surface mount application.

Figure 5:
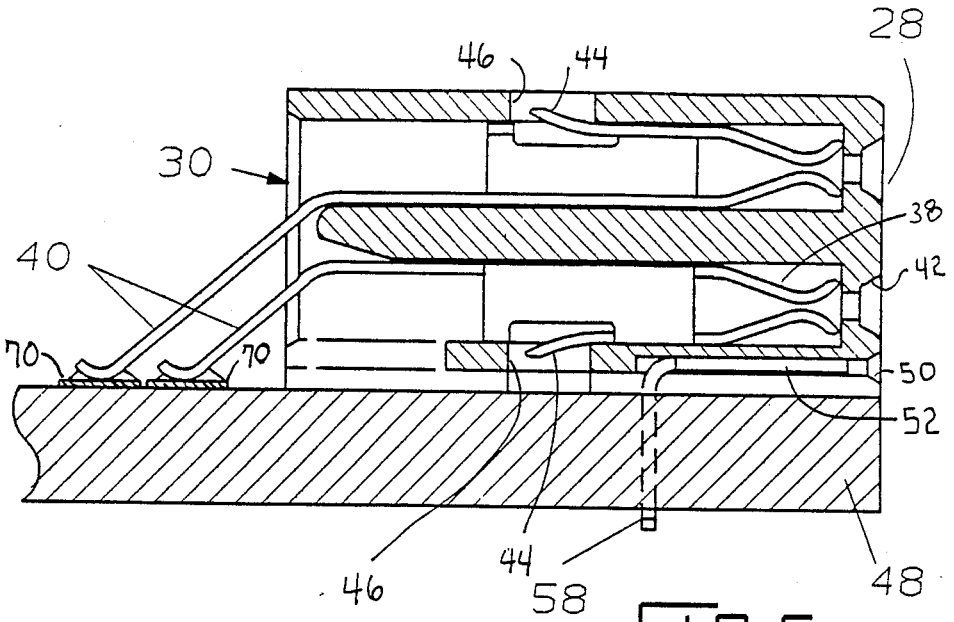
FIG. 5 is a side view of an alternate embodiment of the receptacle of FIGS. 1–3 for surface mount applications.

Solder clip 52 may be used in connectors mounted in through hole applications as shown in FIGS. 1, 2, 3, 7 or in surface mount applications as shown in FIGS. 5 and 8. In surface mount applications, solder clip 52 may or may not have solder tail 58. Solder tail 58 may have a compliant pin configuration to provide an interference fit with the throughole in which it is inserted. The interference fit would aid in securing connector 20 in position on a printed circuit board until it is soldered in place. The number of solder clips 50 required to secure housing 26 to a printed circuit board would vary depending on the size of housing 26 but typically would range from one to three.

Solder clip 52 may function only as a mechanical securing means to secure housing 26 to a printed circuit board or may also function as a ground as shown in FIG. 8 wherein solder tail 58 is soldered to ground pad 80. Ground pad 80 and solder tail 58 in providing means for grounding may function to ground a shield in a shielded version of connector 20.

Contacts 34 in header 24 of FIGS. 7 and 8 are pins 72, typically 0.015 inch square. Header 24 may have shroud 74, side latches 76 and top latch 78 for securing a complementary connector thereto.

A connector has been described having a solderable mechanical retention that engages recessed channels in the bottom face of the connector housing. The solder clip has rounded leading corners to facilitate insertion into the channels, is inserted to a depth determined by a stop and provides an interference fit with the channels to prevent removal therefrom, thereby maintaining the position of the solder clip relative to the housing. The solder clip may have a solder tail for insertion into a plated through hole in a printed circuit board.

We claim:

1. A connector mountable on a surface of a printed circuit board, comprising:

a dielectric housing having a mounting face and a mating face perpendicular thereto, said housing having contact passages extending rearwardly from said mating face;

a plurality of contacts secured in said passages, each of said contacts having a contact section connectable to corresponding circuit paths on the circuit board;

at least one clip receiving recess in the housing, each said clip receiving recess including a pair of spaced channels defining pairs of closely spaced opposed stop surfaces, said pair of spaced channels recessed from and extending parallel to the mounting face; and a solder clip insertable into each said at least one clip receiving recess and extending between said channels, said solder clip having a pair of side edges dimensioned to be received in said pair of spaced channels and movable therealong during insertion to secure said solder clip to the housing when the side edges of said solder clip are received between the opposed stop surfaces of said pair of spaced channels, whereby the solder clip can be attached to the housing subsequent to fabrication thereof and when the solder clip is soldered to a printed circuit board the solder clip functions as a mechanical retention feature that prevents lateral forces applied to the connector such as during mating from rotating the connector away from the printed circuit board.

2. A connector as recited in claim 1 wherein the solder clip further comprises a solder tail extending normal to a plane between the channels.

3. A connector as recited in claim 1 wherein the solder clip further comprises leading corners that are rounded to facilitate insertion of the solder clip into the channels.

4. A connector as recited in claim 1 wherein the solder clip further comprises a rib having a raised area that is substantially coplanar with the mounting face.

5. A connector as recited in claim 1 wherein the solder clip further provides means for grounding.

6. A connector as recited in claim 1 wherein the trailing edge of the solder clip in the region of the channels is offset from the plane of the solder clip, whereby an interference fit is achieved between the solder clip and the channels to maintain the position of the solder clip in the channels.

7. A connector as recited in claim 6 wherein the solder clip further comprises leading corners that are rounded to facilitate insertion of the solder clip into the channels.

8. A connector as recited in claim 7 wherein the solder clip further comprises a solder tail extending normal to the plane between the channels.

9. A connector mountable on a surface of a printed circuit board, comprising;

a dielectric housing having a mounting face and a mating face perpendicular thereto, said housing having contact passages extending rearwardly from said mating face;

a plurality of contacts secured in said passages and extending beyond the mounting face, each of said contacts having a contact section connectable to corresponding circuit paths on the circuit board;

at least one clip receiving recess in the housing, each said clip receiving recess including a pair of spaced channels defining pairs of closely spaced opposed stop surfaces, said pair of spaced channels recessed from the mounting face and extending substantially parallel thereto; and a solder clip insertable into each said at least one clip receiving recess and extending between said channels, said solder clip having a pair of side edges dimensioned to be received in said pair of spaced channels and movable therealong during insertion to secure said solder clip to the housing when the side edges of said solder clip are received between the opposed stop surfaces of said pair of spaced channels, whereby the solder clip can be attached to the housing subsequent to fabrication thereof and when the solder clip is soldered to a printed circuit board the solder clip functions as a mechanical retention feature that prevents lateral forces applied to the connector such as during mating from rotating the connector away from the printed circuit board.

10. A connector as recited in claim 9 wherein the solder clip further comprises a rib having a raised area that is substantially coplanar with the mounting face.

11. A connector as recited in claim 9 wherein the solder clip further comprises leading corners that are rounded to facilitate insertion of the solder clip into the channels.

12. A connector as recited in claim 11 wherein the solder clip further comprises a solder tail extending normal to the plane between the channels and the trailing edge of the solder clip in the region of the channels is offset from the plane of the solder clip, whereby an interference fit is achieved between the solder clip and the channels to maintain the position of the solder clip in the channels.

13. A connector mountable on a surface of a printed circuit board comprising:

a dielectric housing having a mounting face and a mating face perpendicular thereto, said housing having contact passages extending rearwardly from said mating face;

a plurality of contacts secured in said passages and extending to the plane of the mounting face, each of said contacts having a contact section connectable to corresponding circuit paths on the circuit board;

at least one clip receiving recess in the housing, each said clip receiving recess including a pair of spaced channels defining pairs of clearly spaced opposed stop surfaces, said pair of spaced channels recessed from the mounting face; and extending substantially parallel thereto; and a solder clip insertable into each said at least one clip receiving recess and extending between said channels, said solder clip having a pair of side edges dimensioned to be received in said pair of spaced channels and movable therealong during insertion to secure said solder clip to the housing when the side edges of said solder clip are received between the opposed stop surfaces of said pair of spaced channels, whereby the solder clip can be attached to the housing subsequent to fabrication thereof and when the solder clip is soldered to a printed circuit board the solder clip functions as a mechanical retention feature that prevents lateral forces applied to the connector such as during mating from rotating the connector away from the printed circuit board.

14. A connector as recited in claim 13 wherein the solder clip further comprising a rib having a raised area that is substantially coplanar with the mounting face.

15. A connector as recited in claim 13 wherein the solder clip further comprises leading corners that are rounded to facilitate insertion of the solder clip into the channels.

16. A connector as recited in claim 15 wherein the solder clip further comprises a solder tail extending normal to the plane between the channels and the trailing edge of the solder clip in the region of the channels is offset from the plane of the solder clip, whereby an interference fit is achieved between the solder clip and the channels to maintain the position of the solder clip in the channels.

* * * * *